US008033527B2

(12) United States Patent
Pasto

(10) Patent No.: US 8,033,527 B2
(45) Date of Patent: Oct. 11, 2011

(54) ADJUSTABLE LIFTING AND STABILIZATION RESCUE STRUT SYSTEM

(75) Inventor: Cris E. Pasto, Spencer, NY (US)

(73) Assignee: Res-Q-Jack, Inc., Elmira, NY (US)

( * ) Notice: Subject to any disclaimer, the term of this patent is extended or adjusted under 35 U.S.C. 154(b) by 937 days.

(21) Appl. No.: 12/016,531

(22) Filed: Jan. 18, 2008

(65) Prior Publication Data

US 2009/0184299 A1 Jul. 23, 2009

(51) Int. Cl.
*B66F 3/24* (2006.01)

(52) U.S. Cl. ..... 254/134; 254/100; 254/132 R; 248/200.1; 248/499; 280/6.155

(58) Field of Classification Search ..... 254/134, 254/100, 418–425, 132 R; 248/200.1, 352, 248/354.5, 688, 125.8, 499, 500; 280/763.1, 280/766.1, 6.155, 6.156; 410/145, 149, 151
See application file for complete search history.

(56) References Cited

U.S. PATENT DOCUMENTS

| | | | | |
|---|---|---|---|---|
| 2,630,296 | A | 3/1953 | Lucker | |
| 2,687,268 | A * | 8/1954 | Hawes | 254/101 |
| 3,430,911 | A | 3/1969 | Olson | |
| 3,743,125 | A | 7/1973 | Ashley, Jr. | |
| 3,750,254 | A * | 8/1973 | Krajcik | 254/93 R |
| 3,836,030 | A | 9/1974 | Timmons | |
| 4,198,847 | A | 4/1980 | Russell et al. | |
| 4,596,371 | A | 6/1986 | Clark | |
| 4,899,986 | A * | 2/1990 | Tweedy | 254/8 B |
| 5,474,330 | A | 12/1995 | Meehleder | |
| 5,575,492 | A | 11/1996 | Stone | |
| 5,810,333 | A * | 9/1998 | Hickerson et al. | 254/93 R |
| 5,897,100 | A * | 4/1999 | Napier et al. | 254/8 B |
| 6,017,170 | A | 1/2000 | Michalo | |

(Continued)

FOREIGN PATENT DOCUMENTS

WO WO 2007126367 7/2008

OTHER PUBLICATIONS

"Capabear Claw" Howell Rescue Systems, Inc., Oct. 4, 1999 http://www.howellrescue.com/toolpages/stabilization/capabear_claw.htm, Printed: May 4, 2004.

"RescueStrut Vehicle Stabilization Kit" Paratech, Inc., Aug. 30, 2001 http://www.paratech-inc.com/pdfs/vehic48.pdf, Printed: May 4, 2004.

(Continued)

*Primary Examiner* — George Nguyen
(74) *Attorney, Agent, or Firm* — Aquilla Patents & Marks PLLC; Thomas T. Aquilla

(57) ABSTRACT

A lifting strut and stabilization system includes a lower outer tubular member in slidable engagement with an upper extendable inner tubular member, a mechanism for receiving and supporting a jack on the outer tubular member, a pin for optionally restraining the upper tubular member from further engagement into the lower tubular member, while allowing unrestrained extension of the upper tubular member from within the lower tubular member, and a removably attached jack having a bracket at its upper end incorporating a saddle or half-hole for engaging a strut lift pin located in a corresponding saddle, half-hole or flat bearing surface located on the upper end of the lower tubular member, the lift pin extending through the saddle holes in the upper tubular member, such that upon actuation of the jack, the upper jack bracket engages the lift pin and extends the upper tubular member from within the lower tubular member.

23 Claims, 18 Drawing Sheets

U.S. PATENT DOCUMENTS

| | | | | |
|---|---|---|---|---|
| 6,095,474 | A | 8/2000 | Arnold | |
| 6,142,488 | A | 11/2000 | Orr | |
| 6,158,705 | A | 12/2000 | Cudmore et al. | |
| 6,176,056 | B1 * | 1/2001 | MacKarvich | 52/293.3 |
| 6,234,400 | B1 | 5/2001 | Guyer | |
| 6,334,279 | B1 * | 1/2002 | Oliver et al. | 52/127.2 |
| 6,394,405 | B1 * | 5/2002 | Roxton et al. | 248/354.1 |
| 6,776,383 | B2 | 8/2004 | Lanka | |
| 7,240,885 | B1 * | 7/2007 | Sullivan | 248/354.1 |
| 7,434,785 | B1 * | 10/2008 | McMorrow | 254/291 |
| 7,490,813 | B1 * | 2/2009 | Weddle | 254/93 R |
| 7,600,731 | B2 * | 10/2009 | Pasto | 248/352 |
| 7,628,383 | B2 * | 12/2009 | Cumbers | 254/243 |
| 2002/0050422 | A1 * | 5/2002 | Wymann | 182/82 |
| 2005/0258332 | A1 * | 11/2005 | Pasto | 248/676 |
| 2008/0191183 | A1 * | 8/2008 | Rucks | 254/424 |

OTHER PUBLICATIONS

"Holmatro-USA—Rescue Tools and Equipment—Shoring Systems" Holmatro Rescue Equipment, Jul. 11, 200? http://products.holmatro-usa.com/family.asp?fid=sho, Printed May 4, 2004.

"Nightmare Struts" Glick Fire Equipment Co., Inc., Aug. 18, 2000 http://www.glickfire.com/Rescue/struts.htm, Printed: May 4, 2004.

"TeleCribbing" Rescue 42, Inc., May 16, 2001 http://www.rescue42.com/telecribbing.htm, Printed May 4, 2004.

"JackMate Fire/Rescue uses" Rescue 42, Inc., Jan. 25, 1999 http://www.rescue42.com/fireresueuses, Printed: Aug. 30, 2001.

"Crutch" Alpha Rescue, Inc., May 29, 2001 http://www.alpharescue.com/web%20pages/crutcu.htm, Printed May 4, 2004.

"Stump" Alpha Rescue, Inc., May 29, 2001 http://www.alpharescue.com/web%20pages/Stump.htm, Printed May 4, 2004.

* cited by examiner

ADJUSTABLE LIFTING AND STABILIZATION RESCUE STRUT SYSTEM

BACKGROUND OF THE INVENTION

1. Field of the Invention

The invention pertains to the field of portable supports or bracing systems. More particularly, the invention pertains to an adjustable, telescopic lifting strut and stabilization system, suitable for use in stabilizing a vehicle at the scene of an accident or similar emergency situation.

2. Description of Related Art

When an automobile, truck or other motor vehicle is involved in an accident, there are occasions when the vehicle comes to rest on its side or its roof, for example, or against an object, such as a tree, utility pole or another vehicle. In such situations, the vehicle must be stabilized to allow rescue personnel to remove the driver and passengers. Moreover, in order to prevent further injury to the occupants of the vehicle or rescue personnel, or further damage to the vehicle itself, the vehicle usually must be stabilized in the position at which it has come to rest. A roof-resting motor vehicle, for example, can be an especially difficult situation for rescue teams, particularly in terms of vehicle stabilization. Vehicle stabilization is thus the first critical step in securing an accident scene, and quick and simple solutions are desired, as time spent on vehicle stabilization is time not spent on victim extrication and patient care.

Because of the wide variety of positions to which a vehicle involved in an accident may come to rest, it is necessary for rescue teams to have available a stabilization support or bracing system that is adjustable to various positions and heights. In addition, stabilization is a task that typically is performed by rescue personnel, as they prepare to remove the occupants from the vehicle. Therefore, the stabilization support or bracing system should be capable of being assembled quickly and easily. It also is necessary for the stabilization system to be transported easily, so that rescue personnel can quickly bring the stabilization support from an emergency vehicle to the vehicle to be supported. Hence, the weight of the stabilization support or bracing apparatus should be minimized and the components should be compact, since space on rescue vehicles generally is quite limited, due to the large variety of equipment required to handle various rescue operations.

Furthermore, there are instances in which a significant portion of the weight of a vehicle must be supported by the stabilization support or bracing apparatus, necessitating an apparatus or system that can support a large amount of weight (i.e., the weight of a vehicle). Further, since a stabilization support typically is used repeatedly throughout its lifetime, durability also is preferred. It is therefore desirable to develop a vehicle stabilization support that is strong, durable, adjustable and reusable, yet economical and easy to transport and set up, and highly versatile. For example, the ideal stabilization system should be adaptable for use in vehicle rescue, collapse rescue, confined space rescue, trench rescue, as a ram, shore, strut, etc., for stabilizing, lifting, shoring, pushing, ramming, etc.

Stabilization supports of the prior art include wood, such as four-by-four (4×4) beams that are wedged in between a stable surface, such as the ground, and the area of the vehicle to be supported. These primitive shoring supports lack adjustability and are not durable, often being discarded after one use, and suffer from numerous other practical limitations. For example, they are relatively heavy and they cannot be disassembled, collapsed or folded for storage, and thus take up an inordinate amount space in the rescue vehicles, where space is at a premium.

Other stabilization supports of the prior art include various metal strut members, some of which rely on jacks or pneumatic pressure to position and/or stabilize the brace against the vehicle. For example, U.S. Pat. No. 6,017,170, assigned to American Rescue Technologies, Inc., discloses an "Adjustable Self Locking Shoring Strut", consisting of a pneumatic/hydraulic shoring strut for bracing walls in various situations. In its preferred embodiment, this strut contains an internal biasing member that urges contraction, when pneumatic pressure is released. More particularly, the pneumatic/hydraulic shoring strut is composed of an inner and outer cylinder, which form an annular recess therebetween. The cylinders are mounted in first and second caps and an annular drive piston is positioned within the annular recess, creating first and second chambers. A port for injecting air into the first chamber is mounted on the outer cylinder and hydraulic fluid is sealed in the second chamber. A channel is provided in one of the caps, providing fluid communication between the second chamber and an interior cavity located within the inner cylinder, where a working piston is reciprocatingly mounted. The channel has a unidirectional flow control valve and a releasable flow restriction control mounted therein, thereby facilitating the self-locking feature of the strut.

U.S. Pat. No. 6,158,705, assigned to Airshore International Direct Equipment West Ltd., discloses a "Vehicle Stabilization and Support Tool", consisting of a tool for stabilizing and supporting a vehicle by forming a rigid member between a bearing surface and the vehicle, including at least one member having a cylinder and a movable piston that protrudes axially from the cylinder at a cylinder end. The cylinder end is formed with a pair of inclined circumferential surfaces. A collar extends axially from the cylinder and slidably receives the protruding piston. The collar is formed with a pair of internal annular step surfaces corresponding to the cylinder end surfaces. The collar step surfaces and the cylinder circumferential surfaces are engagable to permit rotation and simultaneous axial movement of the collar with respect to the cylinder. A pin is selectively positionable at one of a plurality of holes along the piston for engagement with the collar to prevent movement of the piston with respect to the collar. A locking system is provided for releasably securing the collar against rotation relative to the cylinder. In use, the piston is extended from the cylinder and the pin is inserted through one of the holes along the piston to define an initial extended position. The collar is then rotated to move axially into engagement with the pin and locked in place with respect to the cylinder to define a final fixed extended position of the tool.

U.S. Pat. No. 6,776,383 to Lanka discloses a "Vehicle Bracing Apparatus and Method for Use". The brace includes a main tube including a first end and a second end and defining at least one first set of orifices. An extension tube is disposed in the main tube from the first end and defines at least one second set of orifices. The position of the extension tube is set by selectively aligning at least one set of orifices from the first set and at least one set of orifices from the second set and inserting a fastener through the aligned orifices. A vehicle anchor is removably connected to the extension tube and a footer is removably connected to the second end of the main tube.

U.S. Pat. No. 5,810,333, assigned to Curtiss Wright Flight Systems, Inc., discloses a ram device comprising a spreading tool that includes a hollow tube, a first ram member, and a second ram member. The hollow tube has a tubular wall with an axial throughbore and at least one opening extending through the tubular wall. The ram members are slidingly disposed within the throughbore, and at least one ram member is capable of extending beyond the outer edge of the hollow tube. The tool can be adapted for use with a force multiplying device which transmits an output force through a relative displacement between at least two spreadable tips. The first and second ram members are capable of being spaced apart by the force multiplying device such that the tool is capable of extending the expandable distance of the jaws and increasing the distance over which the output force is transmitted.

U.S. Publication No. 2005-0258332A1, assigned to Res-Q-Jack, Inc., discloses a folding telescopic buttress stand that includes a first two-piece telescopic section having an outer tubular member and an inner tubular member in slidable engagement, the outer tubular member being pivotally attached at its lower end to a base plate, and the inner tubular member having attached at its upper end a second two-piece telescopic section having an outer tubular member and an inner tubular member in slidable engagement. One embodiment includes an end fitting or adapter for engagement with a vehicle or other object affixed to the upper end of the inner tubular member. Another embodiment includes a third two-piece telescopic section having an outer tubular member and an inner tubular member in slidable engagement affixed to the upper end of the second two-piece telescopic section.

A wide variety of stabilization struts are known in the art, such as, for example, those manufactured and sold under the names Rescue 42, Inc. (a.k.a. rescue42) Composite Telecribbing Rescue Struts, Hurst Airshore, Paratech Rescue Support Systems (a.k.a. RescueStrut), Genesis Rescue Systems' Kodiak vehicle stabilization system, Junkyard Dog Industries Nightmare and G-Force rescue struts, Prospan Manufacturing Company, ARS, StabFast, Keeble Rescue Systems Marquee strut, and Powerhawk Power Pusher Rams. Although there are many known devices that are intended to aid in stabilizing a vehicle at the scene of an accident, the prior art devices suffer from a number of limitations. For example, one problem with the prior art devices is that the devices are heavy, cumbersome and difficult to transport and set up. Moreover, lifting struts known in the prior art require pin removal and reinsertion to attach a jack. Furthermore, prior art add-on jacks, such as the Rescue 42 jack, are configured to extend from the strut base up to the upper extension tube, which makes for heavy assembly. Thus, there remains a need in the art for an adjustable lifting strut that is lightweight but strong, durable, adjustable and reusable, yet economical and easy to transport and set up.

SUMMARY OF THE INVENTION

The present invention provides a portable, adjustable, telescopic lifting strut and stabilization system, suitable for use in stabilizing a vehicle at the scene of an accident or similar emergency situation. Briefly stated, the invention provides a telescopic lifting strut and stabilization system that includes a lower outer tubular member in slidable engagement with an upper extendable inner tubular member, with a pocket or catch for receiving and supporting a jack on the outer tubular member, and a pin for restraining the upper extendible tubular member from further engagement into the lower tubular member, while allowing unrestrained extension of the upper tubular member from within the lower tubular member, and a removably attachable jack having a bracket at its upper end incorporating a saddle or half-hole for engaging a strut lift pin located in a corresponding saddle, half-hole or flat bearing surface located on the upper end of the lower tubular member, the lift pin extending through the saddle holes in the upper tubular member, such that upon actuation of the jack, its upper bracket engages the lift pin and extends the upper telescopic tubular member from within the lower tubular member.

According to a preferred aspect of the present invention, herein is disclosed an improved adjustable, telescopic lifting strut and stabilization system that includes a removably attachable jack. An advantage of the present invention is that it provides quick, simple means for stabilizing a vehicle, providing essentially infinite adjustability and a configuration suitable for practically any contemplated application at the scene of an accident.

According to another preferred aspect of the present invention, herein is disclosed an improved adjustable, telescopic lifting strut and stabilization system that includes an attached ratchet strap for securing the strut to another object.

According to yet another preferred aspect of the present invention, herein is disclosed an alternative embodiment including staggered saddle holes on different faces of an extendible tubular member to allow for fine adjustment of the length of the lifting strut.

These and other features and advantages will become readily apparent from the following Detailed Description, which should be read in conjunction with the accompanying drawings.

BRIEF DESCRIPTION OF THE DRAWING

The drawing figures are not necessarily to scale, with the emphasis instead placed upon the principles of the present invention. Additionally, each of the embodiments depicted are but one of a number of arrangements possible utilizing the fundamental concepts of the present invention. The drawings are briefly described as follows.

DETAILED DESCRIPTION OF THE INVENTION

The following description relates to certain preferred embodiments of a portable, adjustable, telescopic lifting strut and stabilization system. Numerous variations and modifications, other than those specifically indicated, will be readily apparent to those of sufficient skill in the art. In addition, certain terms are used throughout the discussion in order to provide a convenient frame of reference with regard to the accompanying drawings, such as "front", "back", "inner", "outer", "upper", "lower", and the like. Such terms are not intended to be specifically limiting of the invention, except where so indicated in the claims.

The invention provides a portable, adjustable, telescopic lifting strut and stabilization system, suitable for use in stabilizing a vehicle at the scene of an accident or similar emergency situation. The invention provides an improved strut for rescue applications having numerous features that extend its utility, including, for example, an attached ratchet strap, a removably attachable lift jack, and other useful features in a similar vein.

Figure 1:
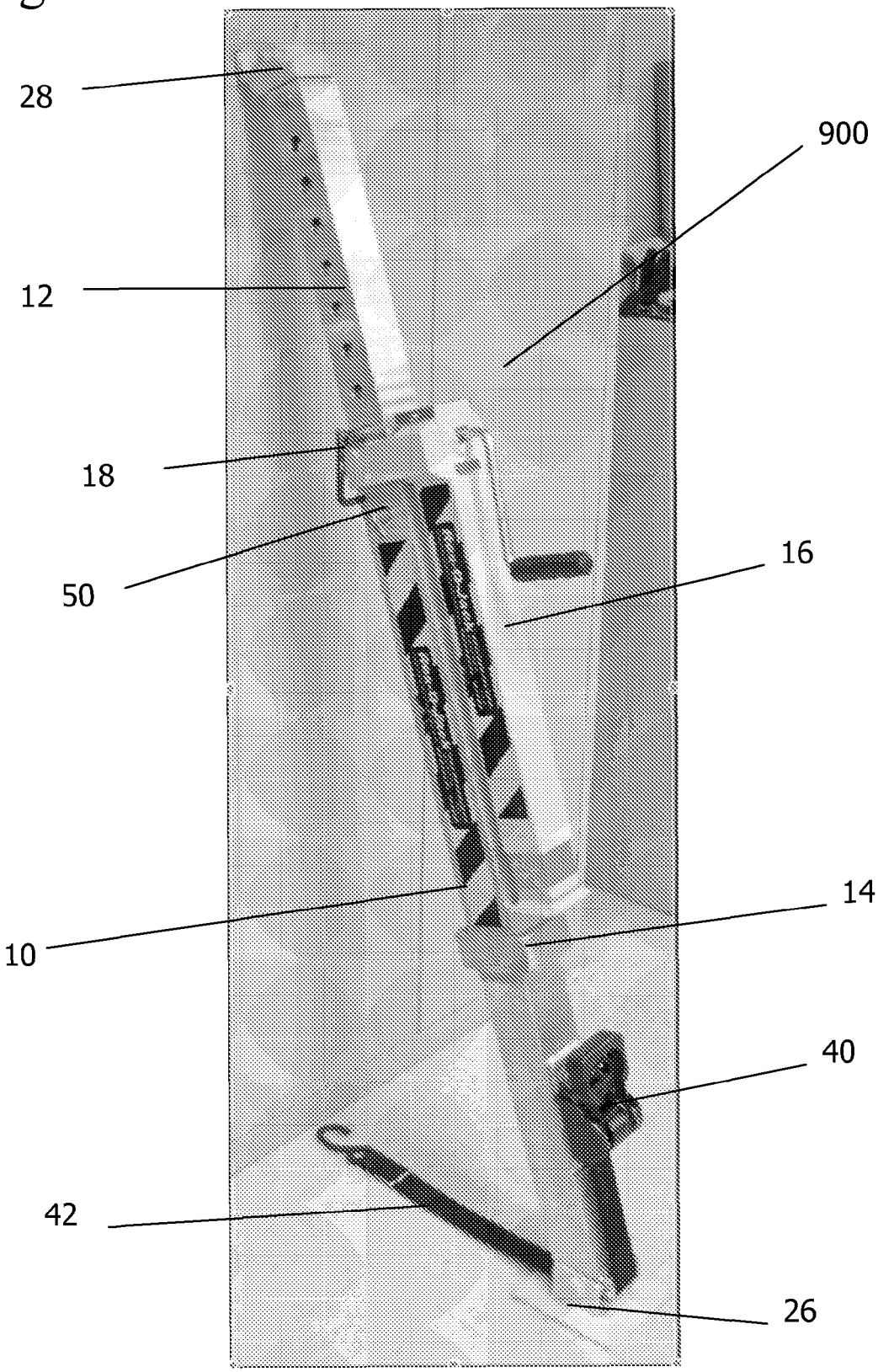
FIG. 1 shows a portable, adjustable, telescopic lifting strut and stabilization system, according to an embodiment of the invention.
Figure 2:
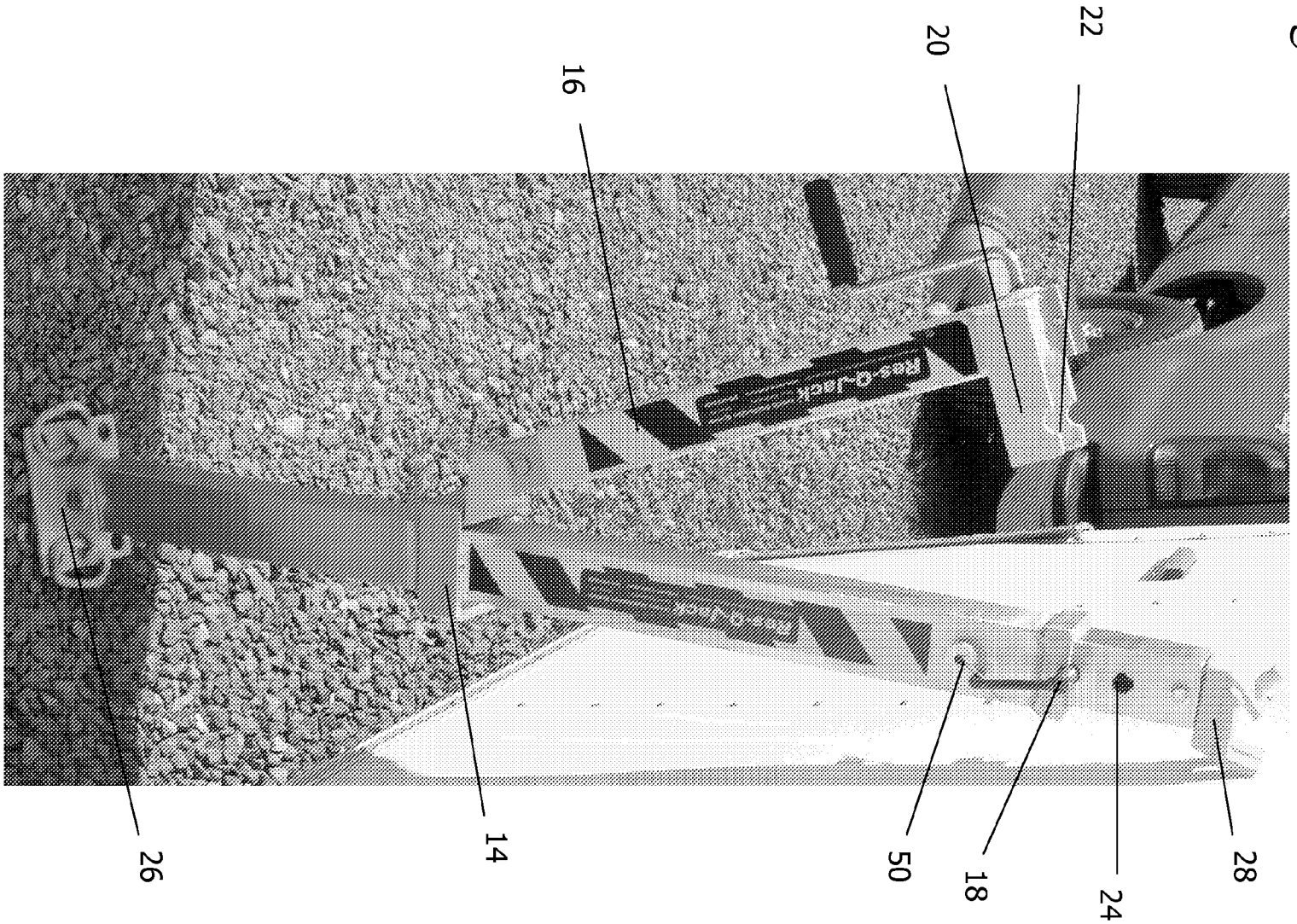
FIG. 2 shows the strut stabilization system of FIG. 1 with a removably attached hand jack being engaged with the strut, according to an embodiment of the invention.

Referring generally to FIGS. 1 and 2, an embodiment of a telescopic lifting strut and stabilization system 900 is shown, including a lower outer tubular member 10 in slidable engagement with an upper extendable inner tubular member 12. The lower outer tubular member 10 is pivotally attached at its lower end to a base plate 26, while the upper extendible tubular member 12 has an end fitting 28 affixed at its upper end for engaging and supporting the object to be stabilized (e.g., an over-turned vehicle). The base plate 26 and end fitting 28 preferably are removable. Note that in the figures a two-piece telescopic strut is shown, which generally is preferable, due to its simplicity of operation. However, additional telescopic sections are deemed to be within the scope of the invention. The inner and outer tubes also optionally include stop collars (not shown), or other means for preventing unsafe over-extension of the sections. Optionally a carrying handle (not shown) is attached to one of the tubular members. In the embodiment shown in the figures, the tubular members comprise an aluminum alloy, however, numerous other materials are acceptable, such as, for example, steel and steel alloys, titanium and titanium alloys, chrome vanadium, other metals and their alloys, as well as non-metal and/or composite materials, including carbon fiber, for example.

Figure 3:
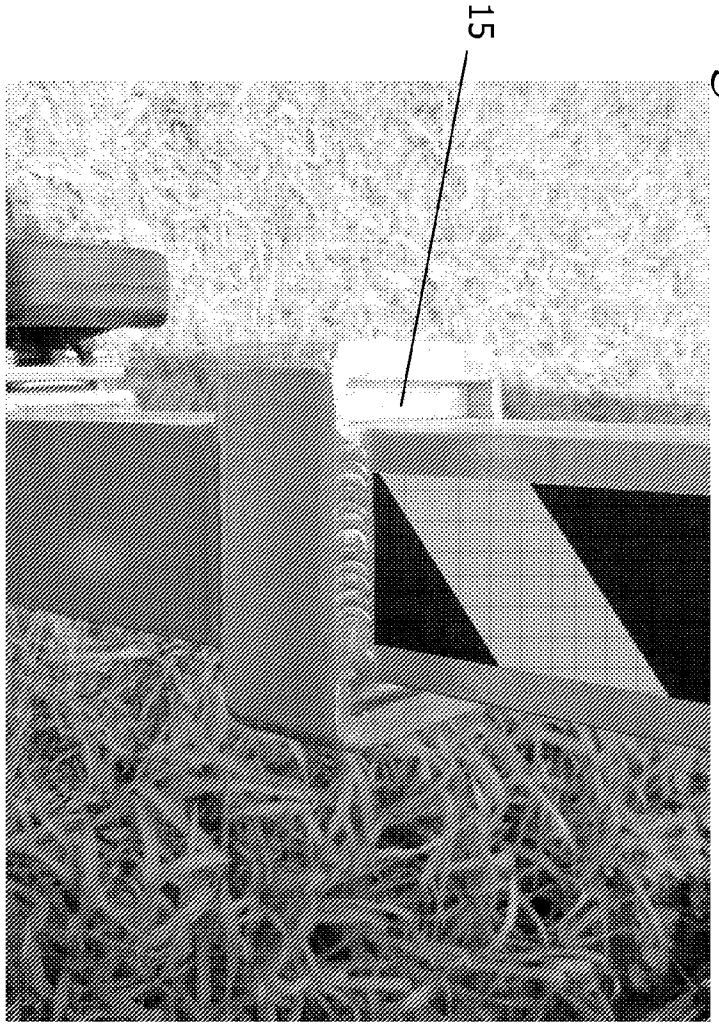
FIG. 3 shows a detail view of the jack-supporting pocket of the strut stabilization system of FIG. 1, according to an embodiment of the invention.
Figure 4:
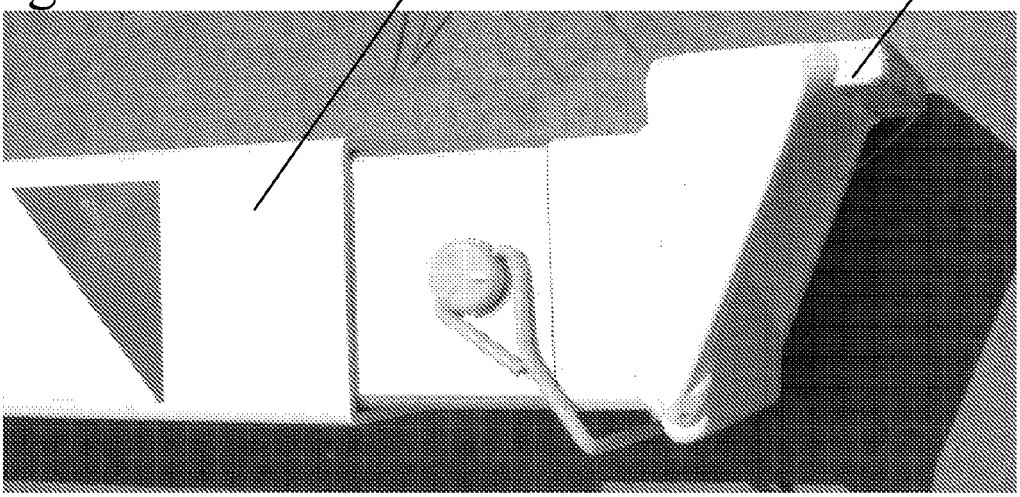
FIG. 4 shows a detail view of the lower jack support bracket of the jack shown in FIGS. 1 and 2, according to an embodiment of the invention.
Figure 5:
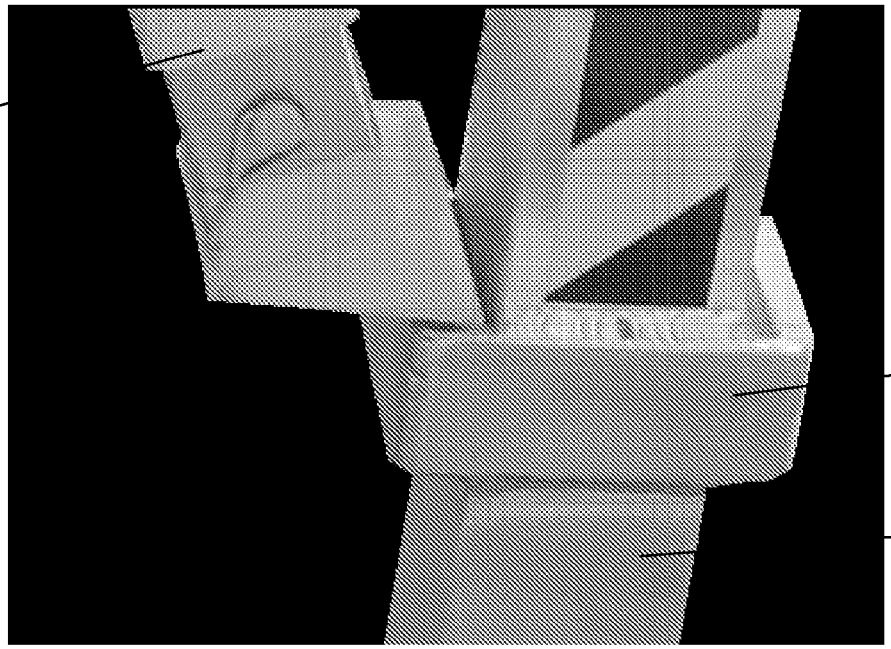
FIG. 5 shows a detail view of the lower jack support bracket of a jack being engaged with the jack-supporting pocket of the strut stabilization system of FIG. 1, according to an embodiment of the invention.
Figure 6:
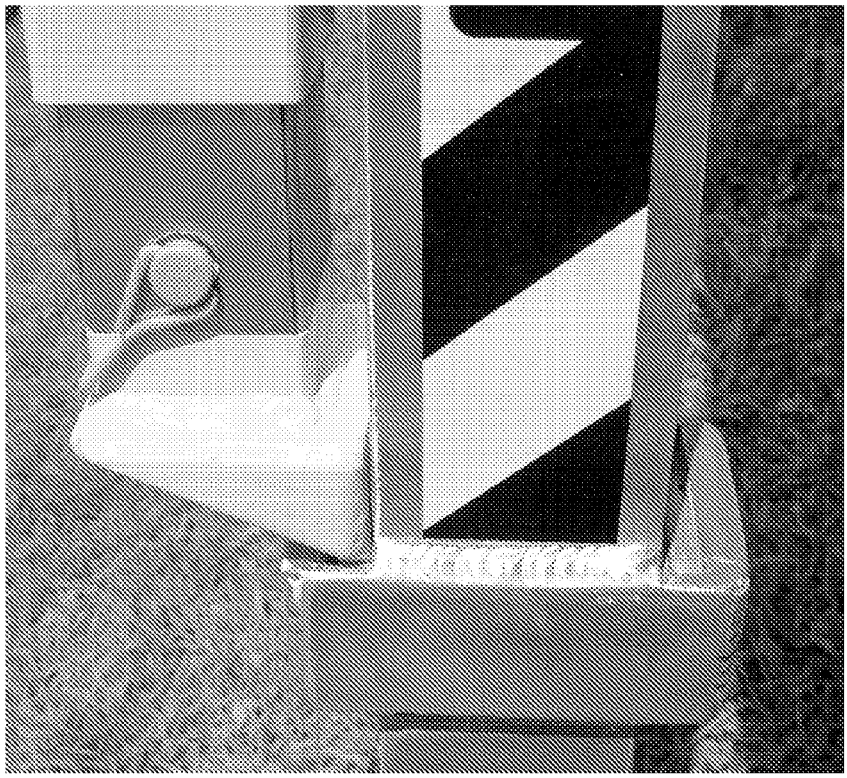
FIG. 6 shows a detail view of the jack fully engaged with the jack-supporting pocket of the strut stabilization system of FIG. 1, according to an embodiment of the invention.
Figure 7:
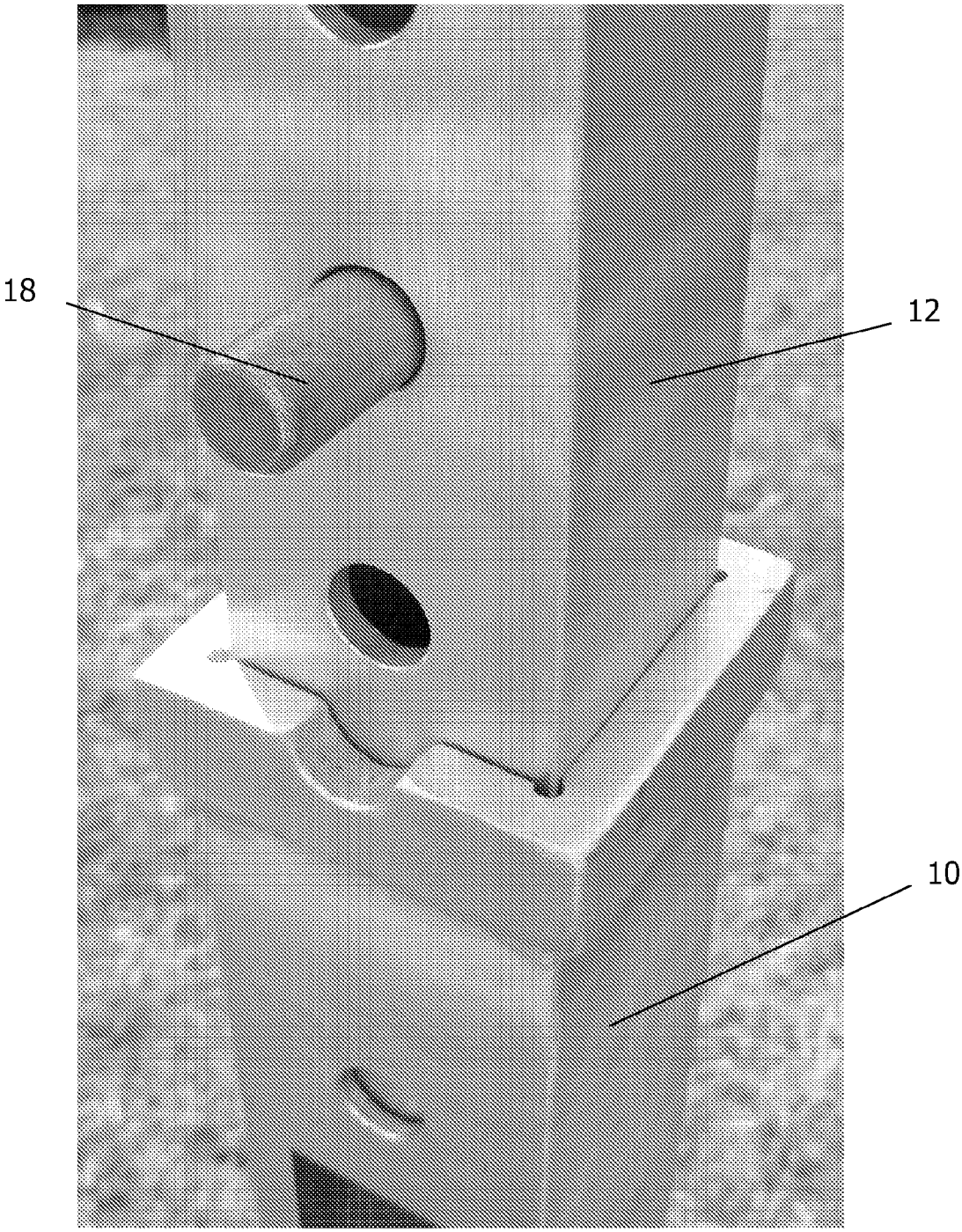
FIG. 7 shows a detail view of the extendible inner tubular member in sliding engagement with the outer lower tubular member of the strut stabilization system of FIG. 1, and an engaged lift pin for restraining further engagement of the upper extendible tubular member down into the lower tubular member, according to an embodiment of the invention.
Figure 8:
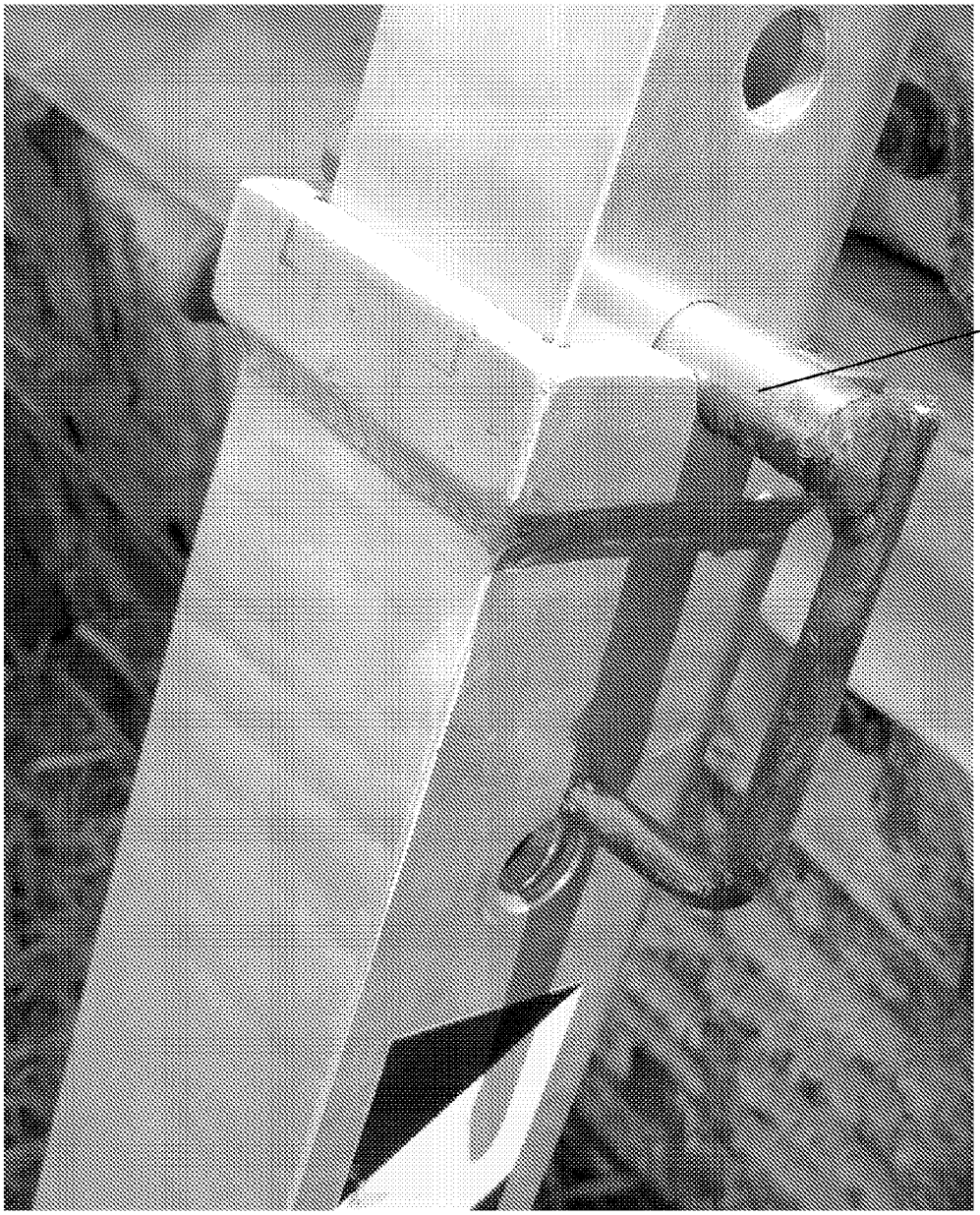
FIG. 8 shows a detail view of the strut stabilization system of FIG. 7, with the lift pin in full engagement with the saddle notches at the upper end of the lower outer tubular member, thereby restraining further engagement of the upper extendible tubular member down into the lower tubular member, according to an embodiment of the invention.
Figure 9:
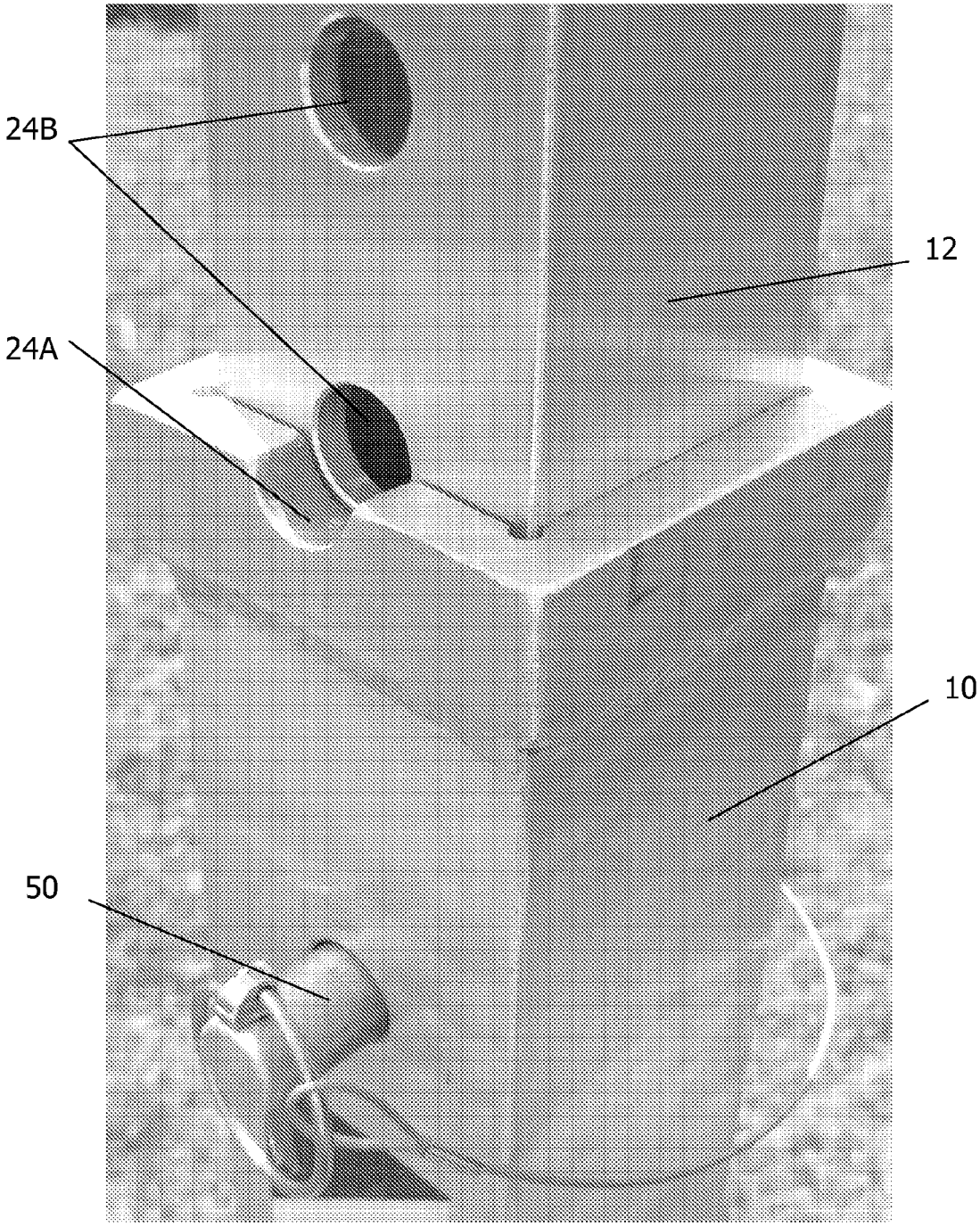
FIG. 9 shows a detail view of the tubular members of FIGS. 7 and 8 locked together with a shoring pin and keeper, thereby preventing the extendible inner tubular member from further engagement into the lower outer tubular member, and also preventing extension of the upper inner tubular member from within the lower outer tubular member, according to an embodiment of the invention.
Figure 10:
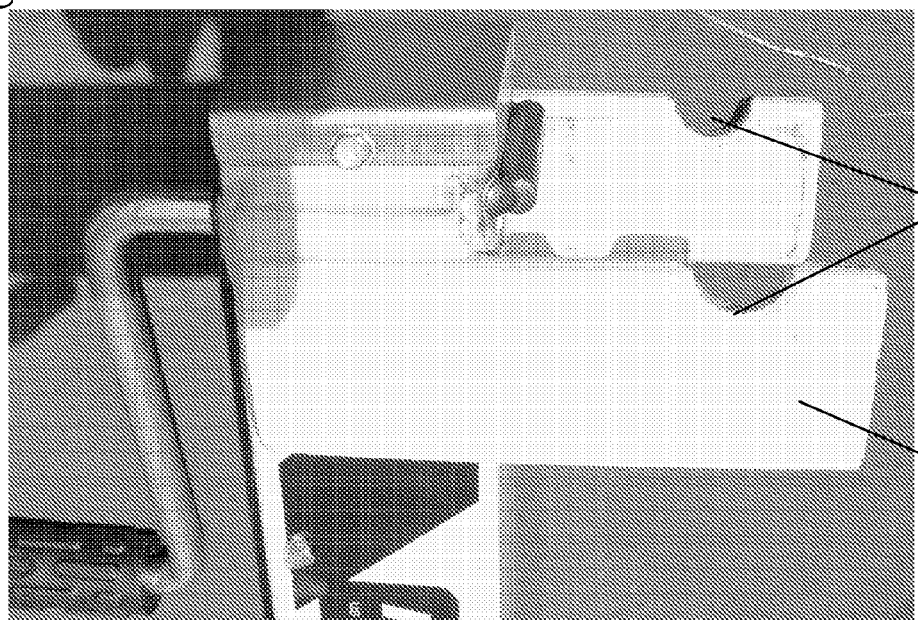
FIG. 10 shows a detail view of the upper end of a hand jack and its lifting bracket and saddle notches for engagement with a strut lift pin, according to an embodiment of the invention.
Figure 11:
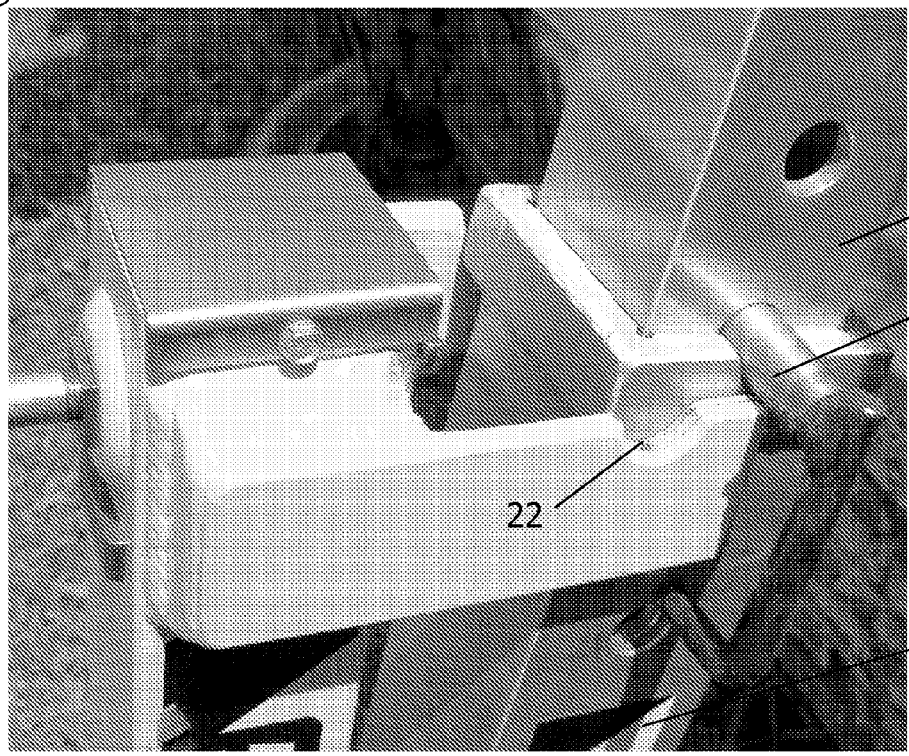
FIG. 11 shows a detail view of the upper end of the hand jack of FIG. 10 and its lifting bracket and saddle notches being engaged with a strut lift pin for lifting the extendible upper tubing member of the lifting strut system, according to an embodiment of the invention.
Figure 12:
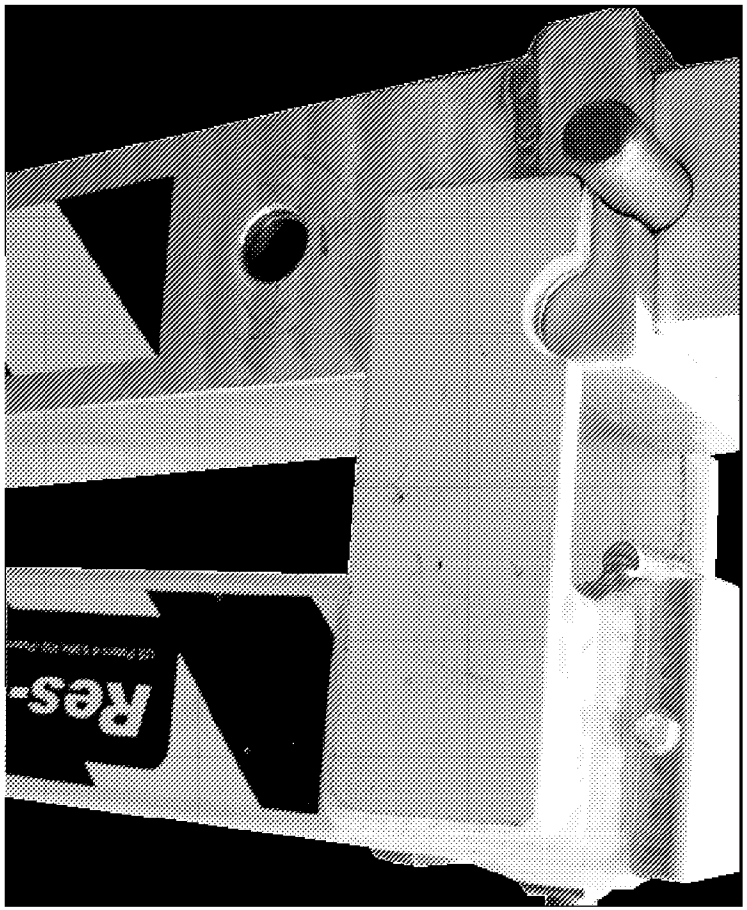
FIG. 12 shows an alternative detail view of the upper end of the hand jack of FIG. 10 and its lifting bracket and saddle notches being engaged with a strut lift pin for lifting the extendible upper tubing member of the lifting strut system, according to an embodiment of the invention.
Figure 13:
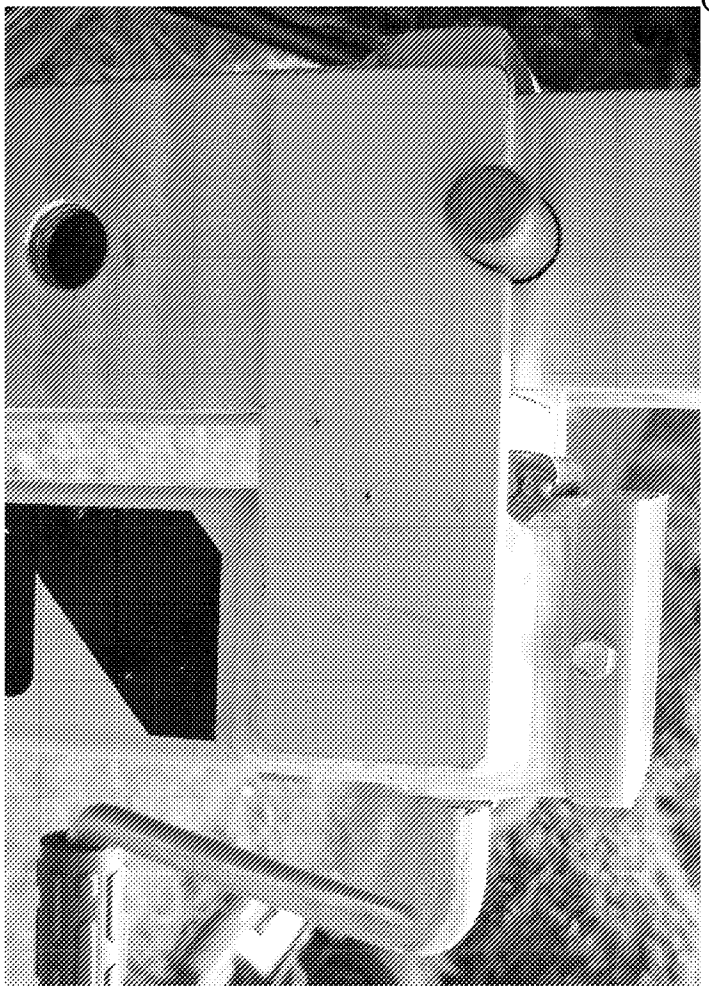
FIG. 13 shows a detail view of the upper end of the hand jack of FIG. 10 and its lifting bracket and saddle notches fully engaged with the strut lift pin for lifting the extendible upper tubing member of the lifting strut system, according to an embodiment of the invention.
Figure 14:
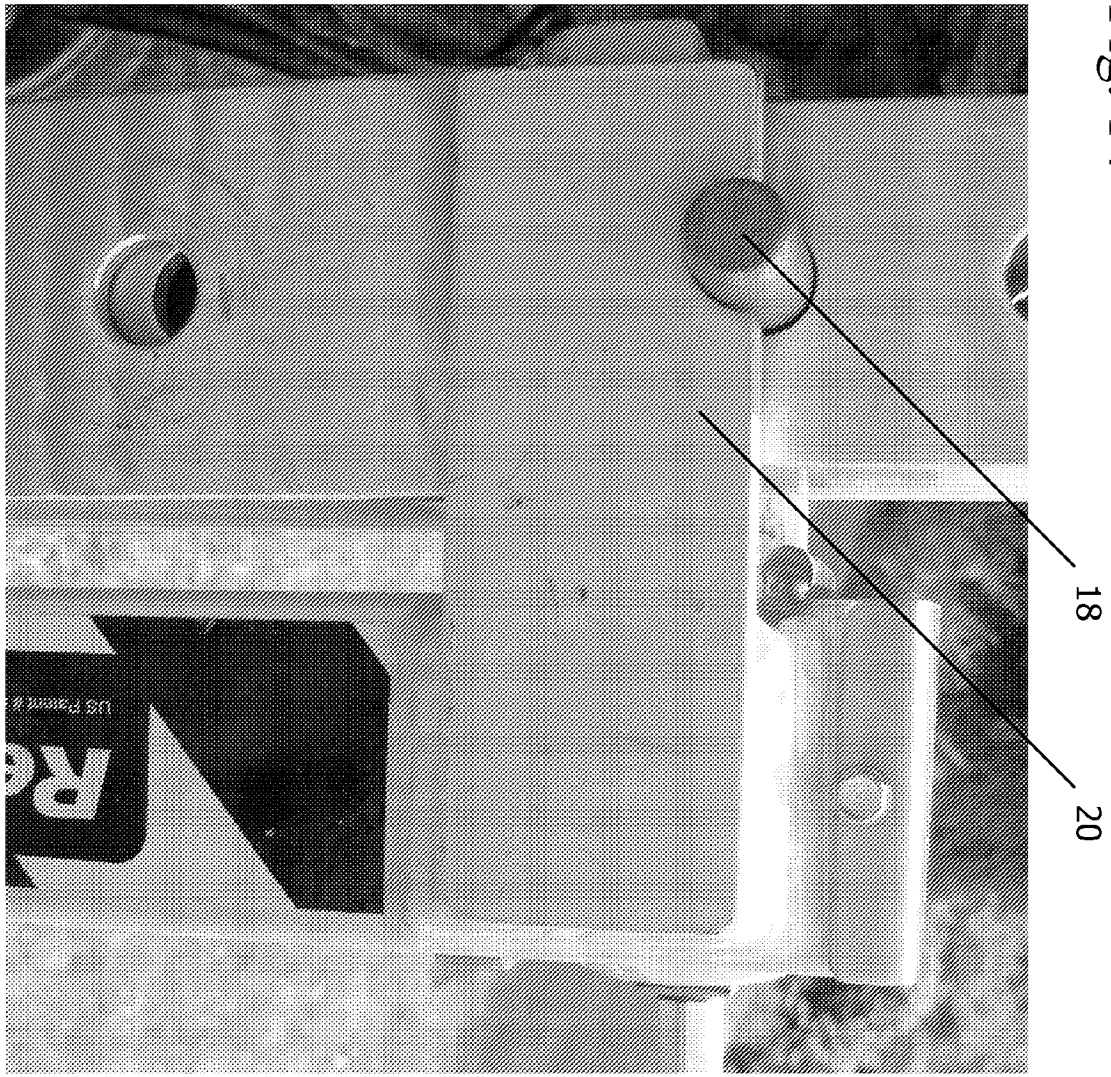
FIG. 14 shows a detail view of the hand jack of FIG. 10 and its lifting bracket and saddle notches fully engaged with the strut lift pin and lifting the extendible upper tubing member of the lifting strut system, according to an embodiment of the invention.
Figure 15:
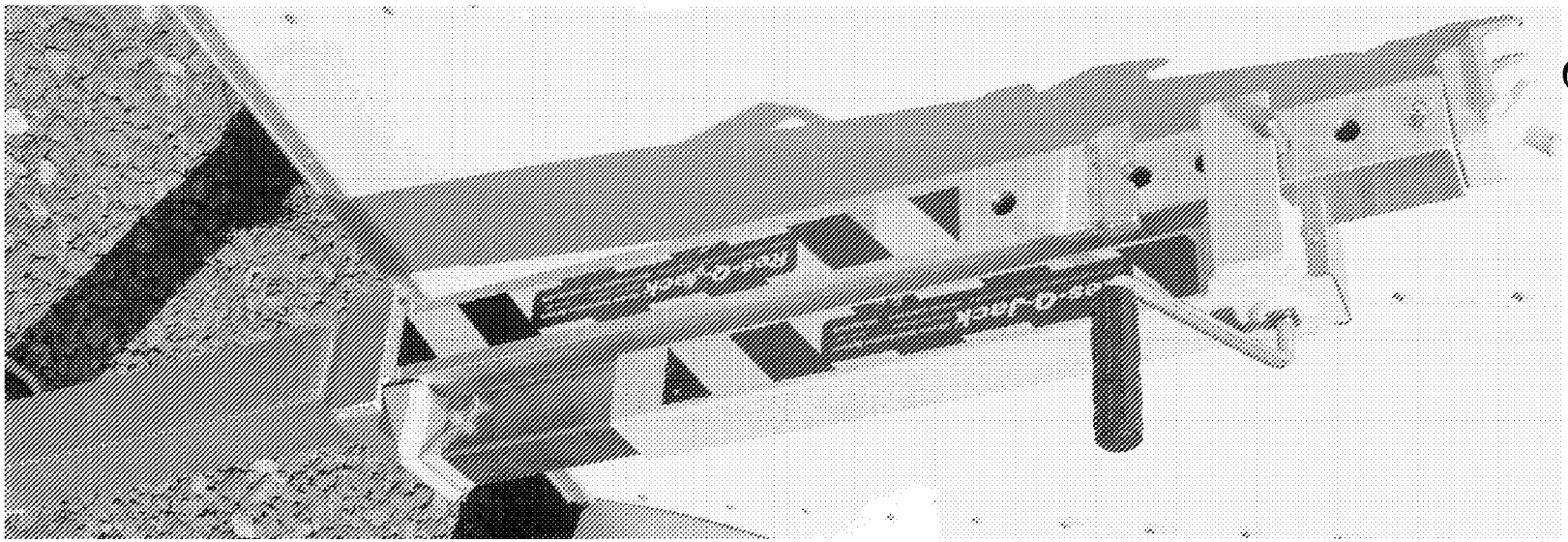
FIG. 15 shows a detail view of the lifting strut and stabilization system of FIG. 1 with a fully attached hand jack engaged with the strut lift pin and lifting the upper extendible tubular member from within the lower outer tubular member, according to an embodiment of the invention.
Figure 16:
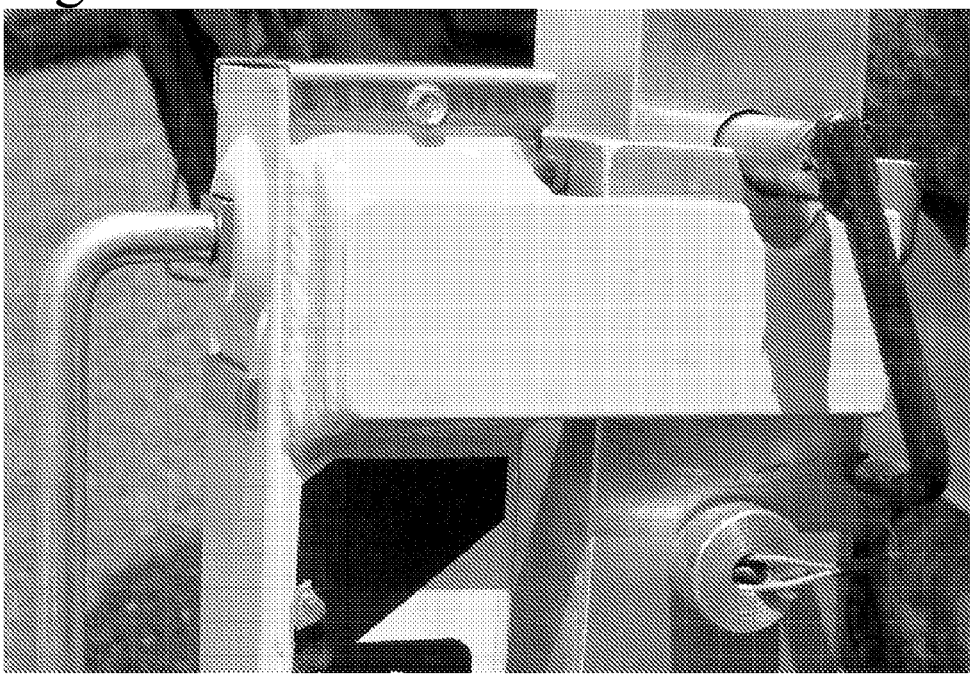
FIG. 16 shows a detail view of the lifting strut and stabilization system of FIG. 1 locked in position with a shoring pin, according to an embodiment of the invention.
Figure 17:
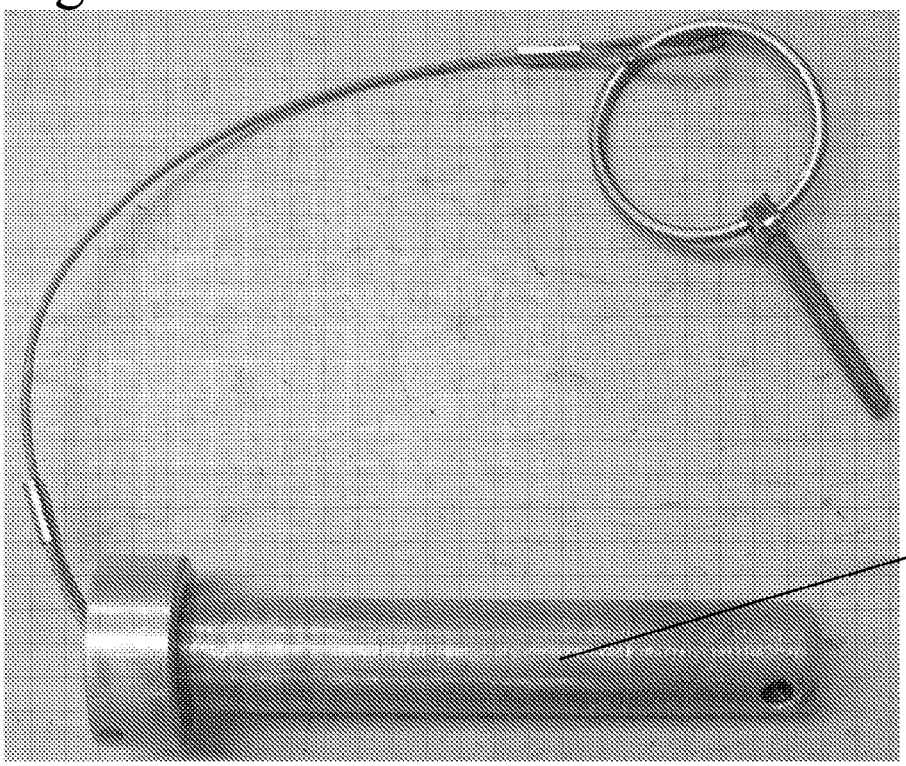
FIG. 17 shows a detail view of the shoring pin, according to an embodiment of the invention.

FIG. 3 shows a detail view of the preferred jack-supporting means 14 of the strut stabilization system. A jack-receiving and supporting means 14, comprising a pocket 15 or catch, is fixed on the outer tubular member 10 for supporting a lift jack 16, and a strut lift pin 18 restrains the upper tubular member 12 from further engagement into the lower tubular member 10, while allowing unrestrained extension of the upper tubular member from within the lower tubular member. The jack-receiving and supporting means can be located on a single face of the tubular member, or for greater versatility, on multiple faces (or all four). Referring now to FIGS. 3-6, the removably attachable jack 16 includes a support lip 17 that inserts into the jack-receiving and supporting pocket 14 affixed to the strut outer tube 10 without pinning. Referring now to FIGS. 7 and 10-14, the upper end of the jack 16 includes a jack lift bracket 20, which incorporates a pair of notches, recesses, saddle or half-holes 22 for aligning with and engaging the strut lift pin 18 located in a corresponding similarly-shaped saddle, half-hole or flat bearing surface 24A located on the upper end of the lower tubular member 10, and engages the corresponding holes 24B in the upper tubular member 12. The lift pin 18 extends through the holes 24B in the extendible upper tubular member 12, such that upon actuation of the jack 16, the upper jack lift bracket 20 engages the lift pin 18 and extends the upper extendible tubular member 12 from within the lower tubular member 10. The lift pin 18 bearing on the paired recesses, saddle holes, half-holes or flat bearing surface 24A located on the upper end of the lower tubular member 10 restricts the upper inner tube from further engagement into the lower outer tube, while still allowing for free extension of the inner tube relative to the outer tube. The shape of the recesses or saddle holes preferably provides for a maximum bearing surface area on the tube wall and lift pin.

Figure 18:
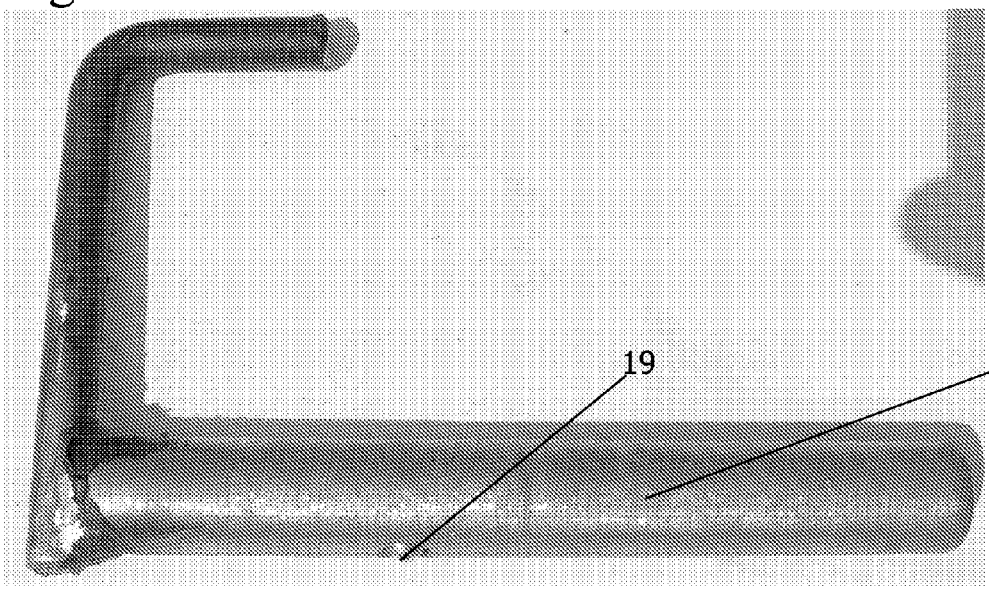
FIG. 18 shows a detail view of the lifting pin, according to an embodiment of the invention.

The lifting means of the strut requires a lift pin that extends a minimum distance out each side of the strut lower outer tube 10 to allow for proper engagement with the lift jack 16. Additionally, the lift pin 18 preferably includes means for preventing unintentional pull-out. It is also preferable for the lift pin to have an ergonomic handle for ease of insertion and removal. Referring now to FIG. 18, to fulfill the above requirements, the lift pin 18 preferably includes a spring loaded detent ball 19 and a handle that is attached to the end of the pin perpendicular to the pin axis. At an end of the handle opposite the end affixed to the pin shaft, the handle preferably has a return leg that runs parallel to the pin shaft. The return leg is of a length which positions the strut tube wall between the end of the return leg and the detent ball. To insert the lift pin 18, push the pin such that the detent ball 19 compresses into the lift pin shaft, thereby allowing the pin to pass through the holes in the tubing. The pin handle should be aligned in a manner such that the end of the return leg will strike the side of strut. The position of the lift pin should thus allow for the add-on jack to properly engage the lift pin.

Some prior art struts are known to have a strap that runs up to the upper end fitting that engages an object at the top of the strut (e.g., vehicle). These straps then run down to a second engagement point with the same object, and then the strap returns to the base of the strut. This assembly is time consuming, requires a greater strap length, and is particularly unfriendly to lifting struts. One type of strut known in the prior art has a base with an off-set pre-attached strap. The strap ratchet mechanism is low on the base pad, where debris is likely to interfere and a user must reach low to operate the ratchet. The strap is off-set to one side of the base, which can cause twisting of the base, unless the strap returns to the opposite side of the base. A strap commonly is attached to the front of a strut base, since this structure is typical of virtually all struts in the field.

Figure 19:
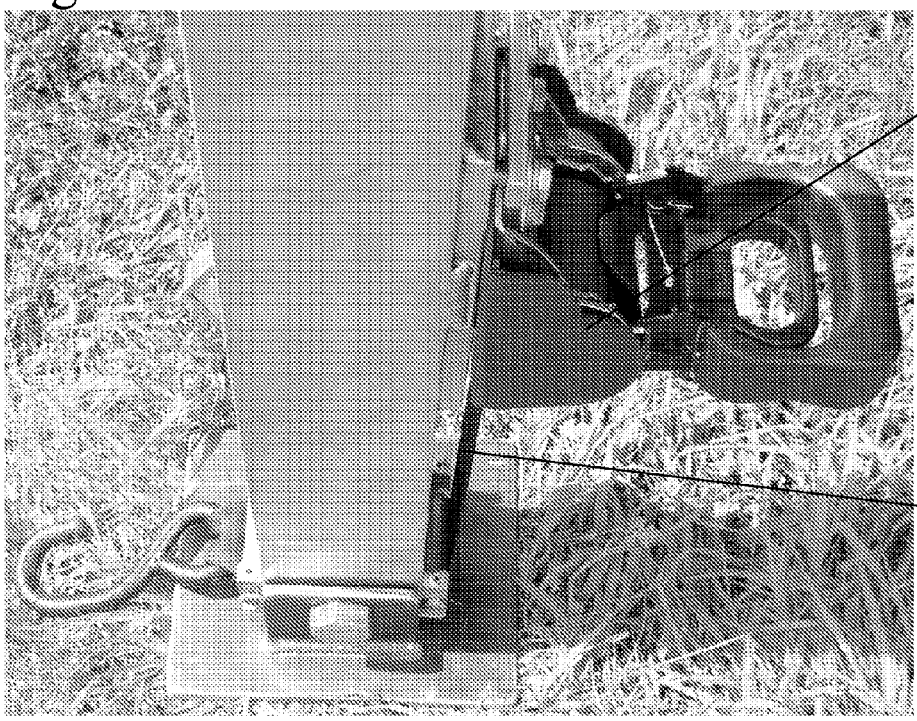
FIG. 19 shows an alternative embodiment according to the invention, with an attached ratchet strap.
Figure 20:
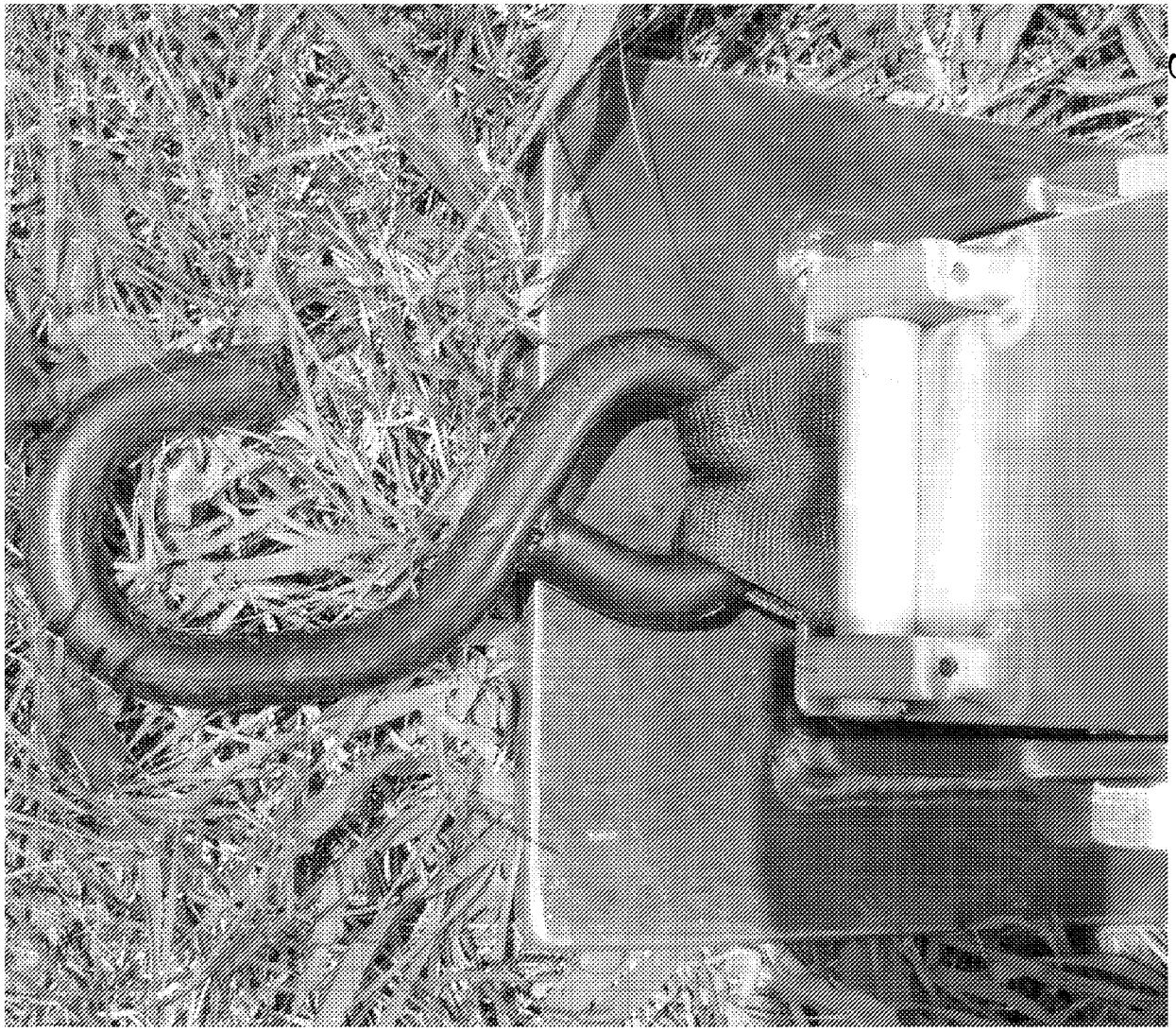
FIG. 20 shows a detail view of the embodiment of FIG. 19.
Figure 21:
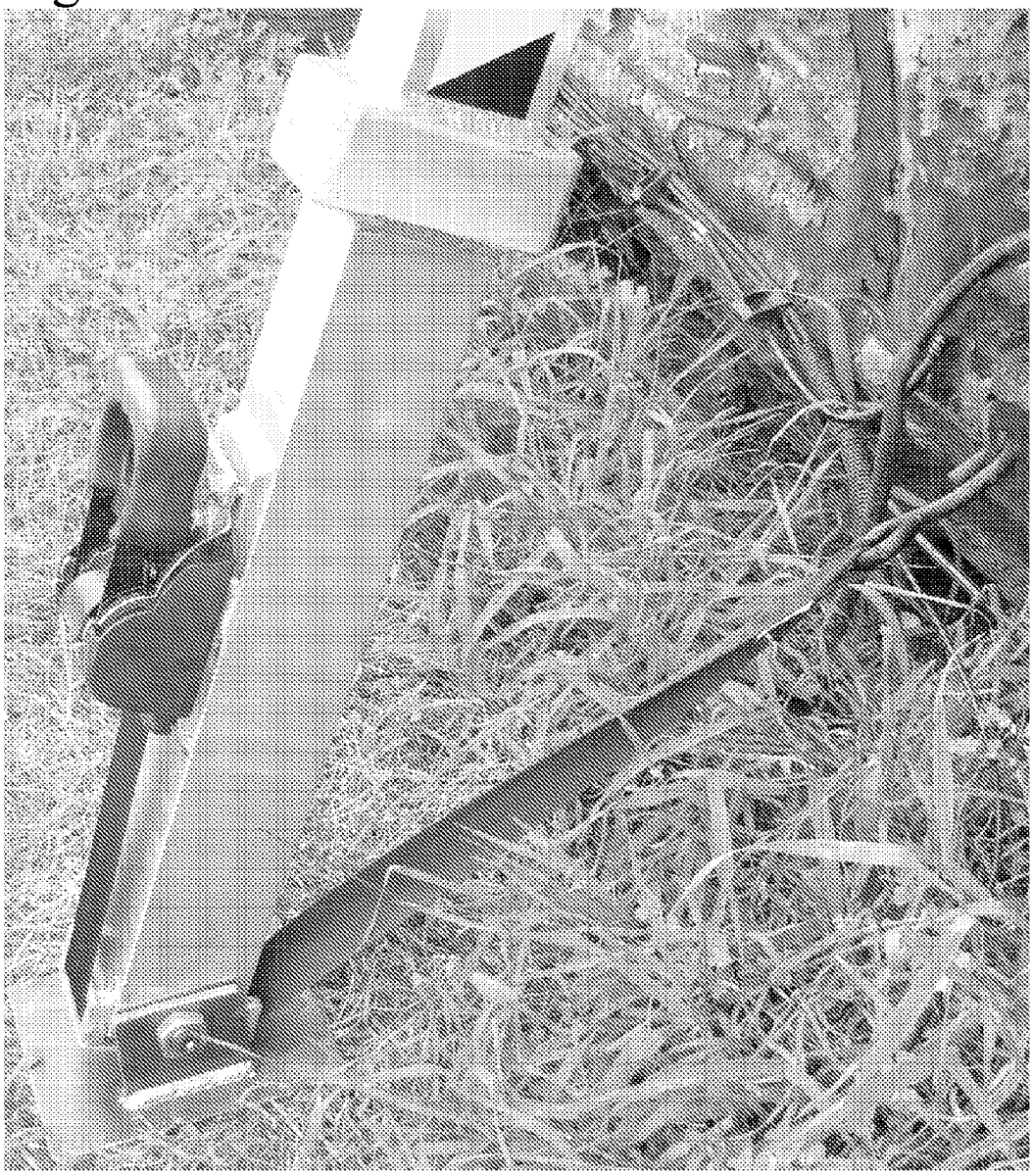
FIG. 21 shows a detail view of the ratchet strap affixed to a vehicle on its side, according to an embodiment of the invention.
Figure 22:
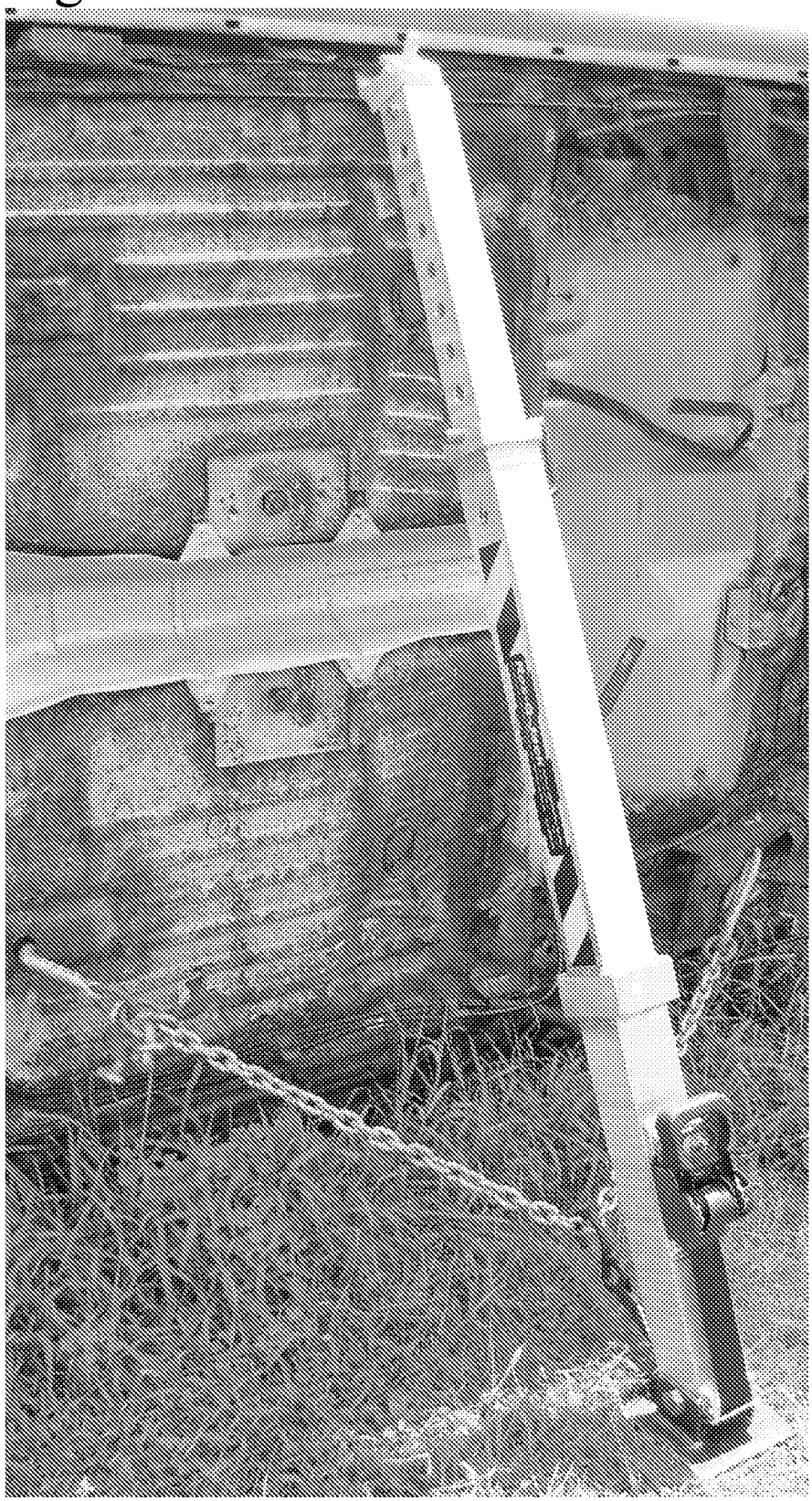
FIG. 22 shows a detail view of the ratchet strap affixed to a chain connected a vehicle on its side, according to an embodiment of the invention.
Figure 23:
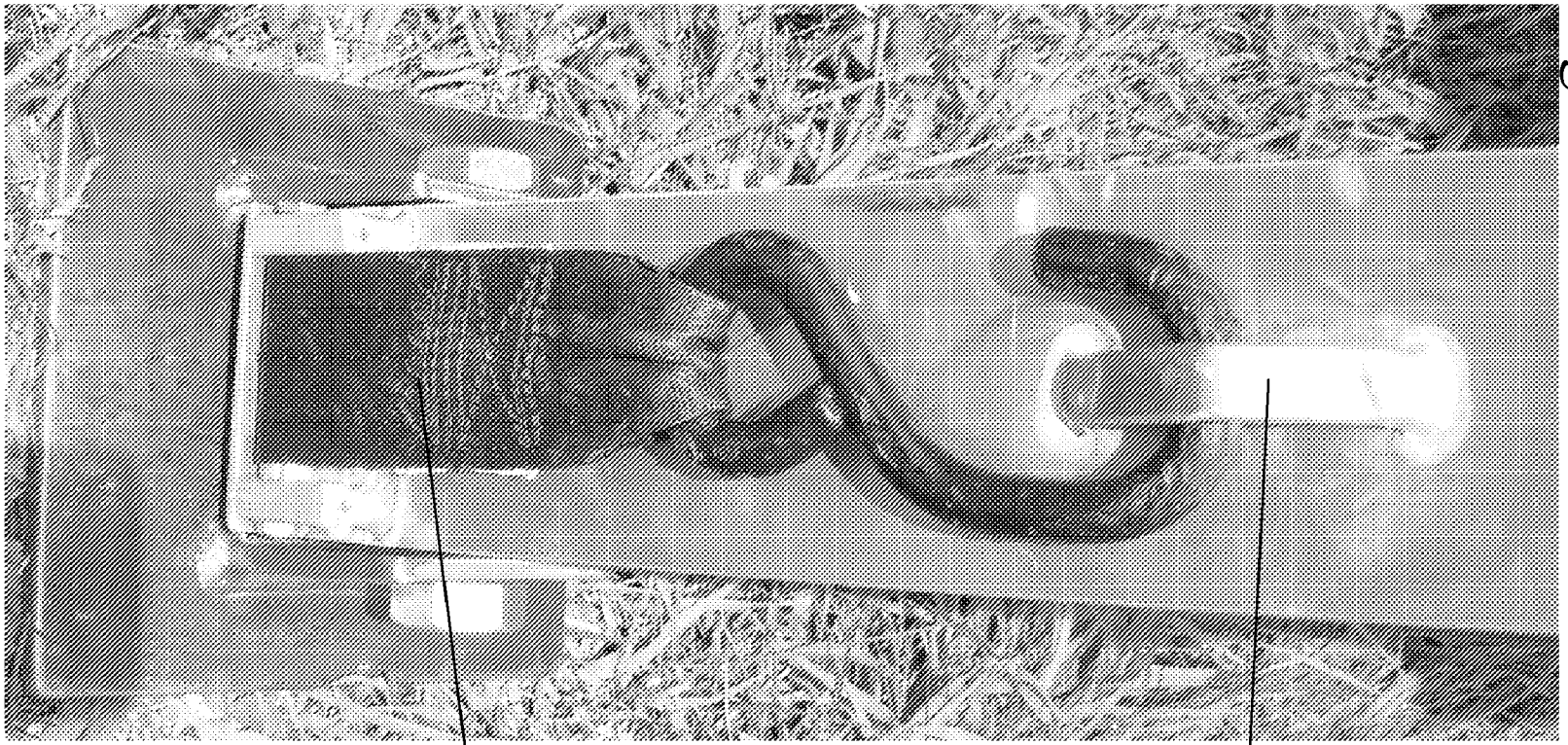
FIG. 23 shows a detail view of the ratchet strap hook end affixed to an on-board storage hook, according to an embodiment of the invention.

Referring now to FIG. 1 and FIGS. 19-23, the attached strap feature of the present invention preferably is of the ratchet strap type packaged within a self-contained recoiling mechanism 40, which provides for superior strap and strap slack management. FIG. 19 shows an embodiment of the stabilization strut according to the invention, with an attached ratchet strap 42, and FIG. 20 shows a detail view of the embodiment of FIG. 19. FIG. 21 shows a detail view of the ratchet strap affixed to a vehicle on its side, and FIG. 22 shows a detail view of the ratchet strap affixed to a chain connected to a vehicle on its side. FIG. 23 shows a detail view of the ratchet strap hook end affixed to an optional on-board storage hook 45, according to another embodiment of the invention. The recoiling strap assembly preferably is mounted to the backside of the lower outer strut tube, at a location between the base and upper end of the lower outer tube. If an add-on jack pocket is affixed to the strut tube, then the strap assembly will be between the base and the catch pocket. The strap is pre-threaded through a set of fairleads attached to the bottom of the lower outer strut tube, between the base plate and the tube bottom. Thus, the hook of the strap is in a ready-to-use position at the front of the base. Another unique feature is the loop attached to the front of the lower outer strut tube, where the strap hook may be removably secured for storage.

To allow the strap some travel, the ratchet handle is placed in the locked open position perpendicular to the lower outer strut tube. In this position, the strap may be extended, however, the strap will automatically recoil, when extension force is released. The strap may be hooked to an object or to additional flexible tie members, if the strap length is inadequate. If necessary, chain(s) or similar flexible tie members can be used to create multiple connection points with an object from the single strap hook point. To tighten the strap, move the ratchet handle into operating range between the locked open free-wheel position and the locked closed position, parallel to the strut. The strap is tightened as the handle is repeatedly moved between the two locking positions. Once the desired tension is achieved, the handle is moved to the locked closed position, parallel to the strut.

Figure 24:
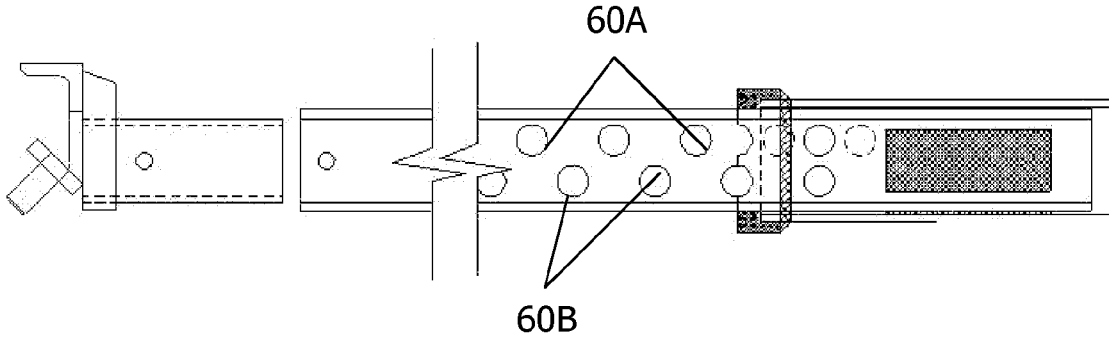
FIG. 24 shows an alternative embodiment according to the invention, having multiple staggered rows of saddle holes for fine adjustment of the strut length.

Referring now to FIG. 24, an alternative embodiment of the lifting strut system is shown. In this embodiment, the tubular strut member has two (2) lines of saddle holes 60A,B to receive the lift pin 18 or shoring pin 50. This concept allows for finer adjustment of the strut length, without concern of shear tearout of the pin from hole to hole. The jack lift bracket in this embodiment includes two saddle holes, similar to the two saddle holes on the stop collar below. The first embodiment will index every 2 inches as the holes are on 2" centers. These holes are also on 2" centers, however, there are 2 lines of them offset by 1". Therefore 1" indexing can be achieved. Optionally, additional sets of saddle holes can be located in other tube walls as well, to obtain an even finer adjustment ability.

The lifting strut members optionally include one or more sections of round or square tubing combined with one or more sections of another round or square tube. The add-on jack technology disclosed herein is compatible with round tube shores, with some slight shape changes in the bottom lip of the jack that engages the strut pocket, and the top saddle bracket that engages the lift pin(s). For fashioning a round tube shore, the catch pocket on the outer shore tube would be a circular pocket all the way around. The jack catch lip would be arched to fit. The top jack saddle bracket would not differ much from the current design, however, the stop collar on the top of the outer tube would be round with saddle holes around the circumference, that could be at various depths to allow for fine adjustment. The inner tube optionally is a round tube with multiple lines of holes staggered, which may involve twist alignment.

One point of potential concern is the indexing issue, when the holes are on 2" centers. This is typically not a problem, when using the apparatus as a stabilization shore with the strut set at an angle, as the angle is adjusted for proper fit/tightening. However, when the strut is set vertically, as in collapse shoring or similar, the problem becomes more apparent. This is where an adjustable jacking head may come into play with a minimum of 2" adjustment.

Another solution to the indexing issue is the staggered off-center holes in the strut wall and possibly additional holes in the opposite walls to allow for finer adjustment.

Another situation that poses a potential problem is that, when you put the add-on jack on and you crank it all the way out, you may not end up on a hole to pin. In addition, it may be undesirable to let the jack down to the nearest hole, as this could have adverse affects on the rescue. There are a few solutions to this problem, including: 1) adjust jack travel such that it travels ¼" over 12" (i.e., up to 12¼"), that way you always have a hole when you get to full extension; 2) put a second jack on the back side of the strut, while the first jack is still on the front, so that you can raise more from the backside until lift is achieved or until you reach the next hole for pinning. This is a good reason for using two (2) lift pins and no shoring pins. The first lift pin can't be used, as it is loaded by the first jack, so slip the second lift pin in down as close to the outer tube as the available holes will allow, and put the second jack in place and crank it up slightly to engage the pin.

In some situations, one could even put a third or fourth jack on (i.e., one on each side of the strut).

However, putting a second jack on the back side of the strut may be difficult, due to proximity to the object being supported, so an alternate embodiment of the strut would have a jack pocket, saddle pin holes, and indexing holes on all four (4) sides of the strut—a second (or primary) jack could also be placed on the side of the strut. This requires a little more clearance between the jack and strut, but in this configuration one can have a pair of staggered holes on each side of the jack and achieve finer indexing as well.

According to its contemplated use, to use the adjustable telescopic strut with the shoring pin, place the strut base on the ground surface with the upper end leaning toward the object to be supported, away from the operator side or the side with the affixed ratchet strap assembly. Remove the shoring pin to allow for extension of the inner tube, and extend the inner tube to its desired position. Replace the shoring pin in the conventional hole in the outer tube, release the lock on the retractable ratchet strap assembly and place it in the free-wheel position. Attach the end of the strap to an object such that the object, strut and strap form a triangle. Tighten the strap with the ratchet mechanism. To lift the object, insert the lift pin through the saddle holes in top of the outer tube; place the jack bottom lip into the catch pocket affixed to the outer strut tube; push the jack top in, such that the saddle holes on top of the jack lift bracket align below the lift pin. Raise the jack slightly to relieve pressure on the shoring pin. Remove the shoring pin and lift the extendible tubing member to the desired point. If full jack extension is achieved, yet additional lift is desired, insert the shoring pin or a second lift pin, reset the jack or get second jack, and repeat process. Full strut extension is achieved, when internal stop collars meet. Note that the shoring pin is not necessary; shoring and lifting can be accomplished through use of lift pin only, if so desired.

In lieu of stop collars, an improved means for preventing over-extension of a telescopic stabilization strut includes a connecting rod or similar rigid member, or a cable or similar flexible connection attached to or near the base and run up through the inside of the outer and inner tube or tubes. The top of this rod includes a J-shaped hook or other catch means for stopping extension of the inner tube or tube. The hook or catch means engages a cross member fixed to the lower end of the inside tube, or other means for catching the connecting member to prevent over extension.

In a strut comprising square perforated tubing, one problem is that a rigid connecting rod running up through the center could interfere with pinning successive sections to secure the telescopic tubular members. One means to circumvent this problem includes adding a rigid connecting member which positions the rod in the corner of the inside tube or tubes. A flexible connecting member, however, will readily move aside, when pinning through the perforations to secure the telescopic tubular members.

An alternative embodiment includes an inner tube or tubes containing an open slot along the entire length, with the exception of a length near the end determined by the overlap requirement. The outer tube includes a pin or similar component, which slides freely along the inner tube slot. Once minimum overlap is achieved, the pin contacts the end of the slot, preventing further extension. The pin optionally is rigidly fixed, spring loaded, removable, or otherwise attached and activated. Likewise, the slot optionally is located within the outer tube or tubes and the stop pin on the inner tube or tubes.

Another option is a square outer tube with a round stop collar affixed to the top to allow for a round inner tube.

It is to be understood that the architectural and operational embodiments described herein are exemplary of a plurality of possible arrangements to provide the same (or equivalent) general features, characteristics, and general system operation. Therefore, while there have been described the currently preferred embodiments of the present invention, those skilled in the art will recognize that other and further modifications may be made, without departing from the spirit of the present invention, and it is intended to claim all modifications and variations as fall within the scope of the appended claims. Accordingly, it must further be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A telescopic strut system, comprising:

a lower outer tubular member in slidable engagement with an upper extendable inner tubular member, wherein said tubular members are square or round;

means for receiving and supporting a jack affixed to an outer surface of said outer tubular member for lifting and extending said upper inner tubular member, wherein said jack is received and supported without requiring insertion or removal of any pin or other fastener;

a substantially planar base plate pivotally attached to a lower end of said lower outer tubular member for engagement with the ground or a floor; and an end fitting or adapter affixed to an upper end of said upper inner tubular member for engagement with a vehicle or other object.

2. The telescopic strut system of claim 1, further comprising a removable cap at said lower end of said lower outer tubular member that allows for disassembly of the inner and outer tubular members.

3. The telescopic strut system of claim 1, further comprising means for preventing overextension of at least one telescopic tubular member thereof.

4. The telescopic strut system of claim 3, wherein said preventing means is selected from the group consisting of painted warning sections, a stop collar located at an end of a telescopic tubular member, and a hook or catch mechanism.

5. The telescopic strut system of claim 1, wherein said outer tubular member includes at least one pair of notches or saddle holes at an upper end thereof for receiving a pin for restraining said upper inner tubular member from further engagement into said lower outer tubular member, while allowing unrestrained extension of said upper inner tubular member from within said lower outer tubular member.

6. The telescopic strut system of claim 5, further comprising means for locking said inner and outer tubular members that prevents said upper inner tubular member from further engagement into said lower outer tubular member, and also prevents extension of said upper inner tubular member from within said lower outer tubular member.

7. The telescopic strut system of claim 1, further comprising means for optionally restraining said upper inner tubular member from further engagement into said lower outer tubular member, while allowing unrestrained extension of said upper inner tubular member from within said lower outer tubular member.

8. The telescopic strut system of claim 7, wherein said means for optionally restraining said upper inner tubular member from further engagement into said lower outer tubular member, while allowing unrestrained extension of said upper inner tubular member, comprises a pair of saddle holes or notches located at said upper end of said lower outer tubular member for receiving a pin for restraining said upper inner tubular member from further engagement into said lower outer tubular member, while allowing unrestrained extension of said upper inner tubular member from within said lower outer tubular member.

9. The telescopic strut system of claim 1, further comprising a plurality of paired saddle holes arranged in a staggered formation on 2 or 4 walls of said upper inner tubular member.

10. The telescopic strut system of claim 1, further comprising a removably attached jack having one or more brackets at an upper end thereof, said bracket(s) incorporating one or more saddle or half-hole(s) for engaging a strut lift pin located in a corresponding saddle or half-hole, or a flat bearing surface, located on said upper end of said lower outer tubular member, said strut lift pin extending through said saddle holes in said upper inner tubular member, such that actuation of said jack engages said strut lift pin and extends said upper inner tubular member from within said lower outer tubular member.

11. The telescopic strut system of claim 10, wherein said jack comprises a plurality of paired saddle holes arranged such that when said jack is applied to said telescopic strut system, said saddle holes are aligned with said strut lift pin.

12. The telescopic strut system of claim 10, wherein said jack is manual, electric, hydraulic, air, or otherwise powered.

13. The telescopic strut system of claim 10, wherein said jack comprises an adjustable and/or rotatable jacking head.

14. The telescopic strut system of claim 10, wherein said jack has a travel of 12.25 inches.

15. The telescopic strut system of claim 10, comprising multiple jacks on opposite or adjacent faces of said tubular member for engaging multiple lift pins.

16. The telescopic strut system of claim 10, wherein said strut lift pin comprises a handle having a return leg that prevents over-engagement with said tubular members and a detent ball that resists unintended pullout, allowing for locating said lift pin correctly for jack engagement with said lift pin.

17. The telescopic strut system of claim 1, further comprising a ratchet strap assembly affixed to said lower outer tubular member in a manner that allows said strap to extend down between said base plate and said lower outer tubular member and through to an opposite side of said lower outer tubular member for restraining said strut to an object located on said opposite side of said lower outer tubular member.

18. The telescopic strut system of claim 17, further comprising fairleads at said lower end of said lower outer tubular member, allowing for passage of said strap to said opposite side of said lower outer tubular member without damage to said strap.

19. The telescopic strut system of claim 17, further comprising a loop or other means for removably securing a hook of said strap for storage thereof.

20. A telescopic strut system, comprising:

a lower outer tubular member in slidable engagement with an upper extendable inner tubular member, wherein said tubular members are square or round;

a substantially planar base plate pivotally attached to a lower end of said lower outer tubular member for engagement with the ground or a floor;

an end fitting or adapter affixed to an upper end of said upper inner tubular member for engagement with a vehicle or other object; and a removably attached jack having one or more brackets at an upper end thereof, said bracket(s) incorporating one or more saddle or half-hole(s) for engaging a strut lift pin located in a corresponding saddle or half-hole, or a flat bearing surface, located on said upper end of said lower outer tubular member, said strut lift pin extending through said saddle holes in said upper inner tubular member, such that actuation of said jack engages said strut lift pin and extends said upper inner tubular member from within said lower outer tubular member;

wherein said strut lift pin comprises a handle having a return leg that prevents over-engagement with said tubular members and a detent ball that resists unintended pullout, allowing for locating said lift pin correctly for jack engagement with said lift pin.

21. A telescopic strut system, comprising:

a lower outer tubular member in slidable engagement with an upper extendable inner tubular member, wherein said tubular members are square or round;

a substantially planar base plate pivotally attached to a lower end of said lower outer tubular member for engagement with the ground or a floor;

an end fitting or adapter affixed to an upper end of said upper inner tubular member for engagement with a vehicle or other object; and a ratchet strap assembly affixed to said lower outer tubular member in a manner that allows said strap to extend down between said base plate and said lower outer tubular member and through to an opposite side of said lower outer tubular member for restraining said strut to an object located on said opposite side of said lower outer tubular member.

22. The telescopic strut system of claim 21, further comprising fairleads at said lower end of said lower outer tubular member, allowing for passage of said strap to said opposite side of said lower outer tubular member without damage to said strap.

23. The telescopic strut system of claim 21, further comprising a loop or other means for removably securing a hook of said strap for storage thereof.

* * * * *